US008181412B2

(12) United States Patent
Miklosz et al.

(10) Patent No.: US 8,181,412 B2
(45) Date of Patent: May 22, 2012

(54) EXPANDABLE CEILING GRID

(75) Inventors: Mark Miklosz, Western Springs, IL (US); Daniel Jacobs, Geneva, IL (US); Joseph Wascow, Mundelein, IL (US); Stephen Oshgan, Des Plaines, IL (US)

(73) Assignee: USG Interiors, LLC, Chicago, IL (US)

( * ) Notice: Subject to any disclaimer, the term of this patent is extended or adjusted under 35 U.S.C. 154(b) by 728 days.

(21) Appl. No.: 12/140,293

(22) Filed: Jun. 17, 2008

(65) Prior Publication Data

US 2009/0308013 A1 Dec. 17, 2009

(51) Int. Cl.
*E04B 2/00* (2006.01)

(52) U.S. Cl. ..... 52/506.06; 52/645; 52/506.07

(58) Field of Classification Search ..... 52/109, 52/506.06, 645, 633, 506.07; 182/159
See application file for complete search history.

(56) References Cited

U.S. PATENT DOCUMENTS

| | | | | |
|---|---|---|---|---|
| 2,032,226 | A | 2/1936 | Roeder | |
| 2,257,770 | A | 10/1941 | Szego | |
| 2,744,590 | A | 5/1956 | Butts | |
| 2,912,910 | A | 11/1959 | Wilson et al. | |
| 3,083,761 | A | 4/1963 | Attwood | |
| 3,111,202 | A * | 11/1963 | Costello | 52/645 |
| 3,292,332 | A | 12/1966 | Jahn | |
| 3,727,365 | A * | 4/1973 | Stohlquist | 53/450 |
| 4,042,991 | A | 8/1977 | Macy et al. | |
| 4,115,975 | A | 9/1978 | Bliss | |
| 4,625,470 | A * | 12/1986 | Heritage | 52/28 |
| 4,785,603 | A | 11/1988 | Platt | |
| 4,827,681 | A | 5/1989 | Platt | |
| 4,912,894 | A | 4/1990 | Platt | |
| 5,251,412 | A * | 10/1993 | de Almeida Borges | 52/109 |
| 5,363,622 | A | 11/1994 | Sauer | |
| 5,735,100 | A | 4/1998 | Campbell | |
| 6,769,515 | B2 * | 8/2004 | Hillebrecht et al. | 182/159 |
| 2007/0022690 | A1 | 2/2007 | LaLonde | |

FOREIGN PATENT DOCUMENTS

| | | |
|---|---|---|
| JP | 5-221392 A | 8/1993 |
| JP | 5-221394 A | 8/1993 |

OTHER PUBLICATIONS

Notification of Transmittal of the International Search Report and the Written Opinion, Written Opinion of the International Searching Authority, International Search Report dated May 12, 2010, PCT/US2009/044582, filed May 20, 2009.

* cited by examiner

*Primary Examiner* — Basil Katcheves
(74) *Attorney, Agent, or Firm* — Pearne & Gordon LLP

(57) ABSTRACT

A preassembled suspended ceiling grid module comprising a plurality of parallel main tees and a plurality of cross tees, the main and cross tees each having horizontal flanges extended to both sides of a central plane, the cross tees being joined at their ends to the main tees with end connections that enable the module to be folded in a plane corresponding to an eventual ceiling plane in a zigzag pattern, such that the cross tees lie in directions generally parallel to the main tees with the cross tees connected on a side of a particular main tee being folded in a common direction relative to their end connection, and where connected to an adjacent main tee being folded in an opposite direction relative to their end connections with said adjacent tee.

23 Claims, 4 Drawing Sheets

EXPANDABLE CEILING GRID

BACKGROUND OF THE INVENTION

The invention relates to improvements in suspended ceiling grid structure.

PRIOR ART

Suspended ceilings typically include a rectangular metal grid that supports rectangular tiles. The grid elements ordinarily are suspended from overhead structure by spaced hanging wires and, most commonly, have a cross-sectional shape of an inverted "T". The tiles are removably layed onto the flanges of the tees. More specifically, the grid is ordinarily constructed in "stick-like" fashion with main tees first being suspended and cross tees thereafter being individually assembled onto the main tees. Skilled installers have developed various techniques and methodologies to reduce the time required to erect a ceiling grid. The need to individually handle, align and insert tees into main tee slots has presented a barrier to further large reductions in labor for the erection of a grid.

SUMMARY OF THE INVENTION

The invention provides factory assembled grid modules for suspended ceilings that can significantly reduce the labor needed to erect a grid. A module comprises multiple main tees and a complimentary set of cross tees. In accordance with the invention, the cross tees are hinged at their ends to the main tees at locations regularly spaced along the main tees. The module can be warehoused and shipped in a collapsed configuration of limited volume in which the tees are all aligned in the same or essentially the same direction immediately adjacent one another.

The module is expanded when it is being erected by simply swinging the cross tees on their hinged ends relative to the main tees. In a disclosed embodiment of the invention, the hinge joints are arranged to allow the cross tees to fold against the main tees with their flanges overlying the main tee flanges to advantageously reduce the girth of the collapsed module. Still further, the disclosed hinge structure has an indexing or detent feature that biases the expanded grid into a squared-up configuration.

DESCRIPTION OF THE PREFERRED EMBODIMENT

Figures 1A, 1B, 1C, 1D:
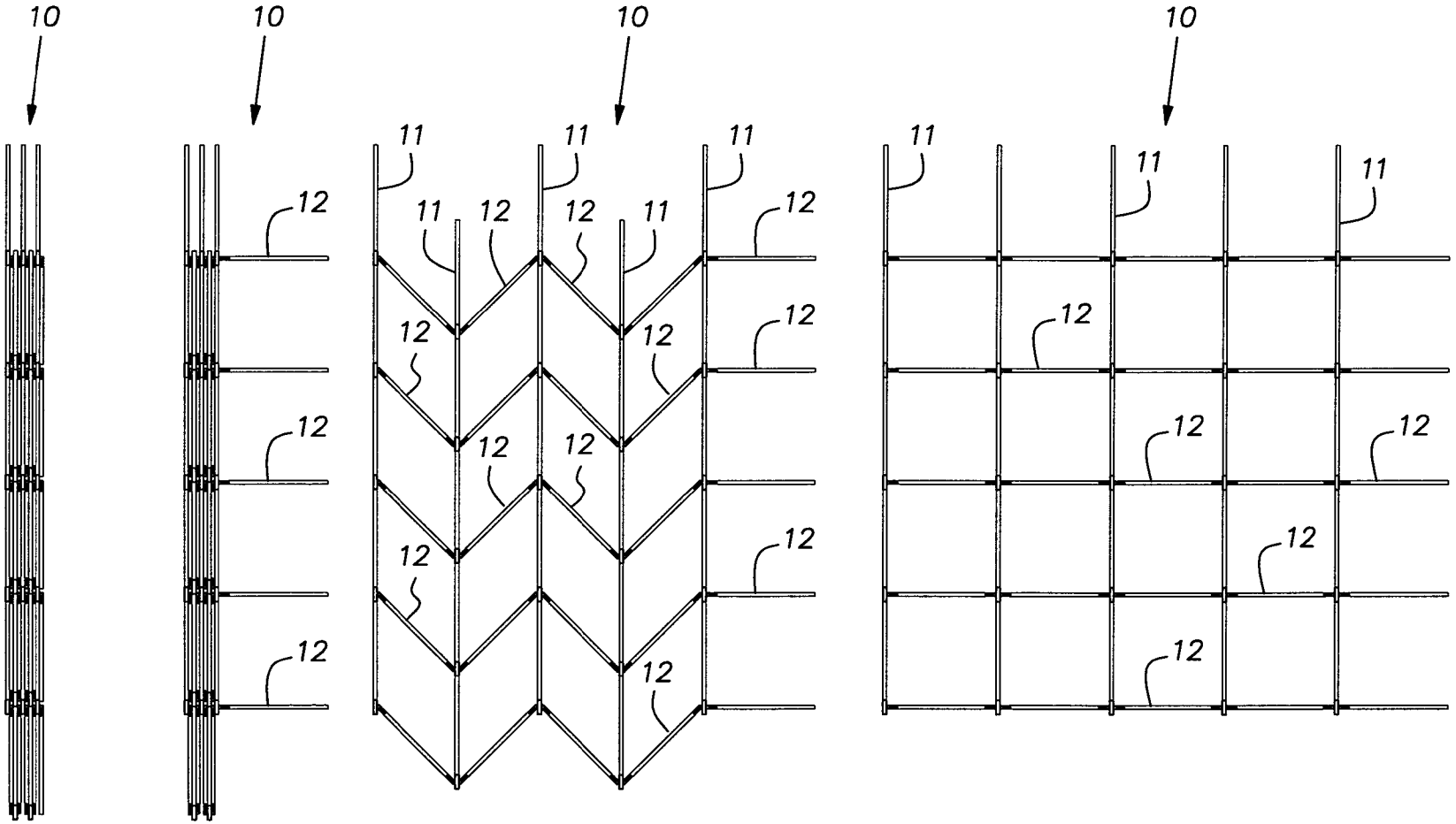
FIGS. 1A, 1B, 1C, and 1D are diagrammatic plan views of a progression of a grid module from a fully collapsed condition to a fully expanded condition. Each figure represents a successive stage.
Figure 2:
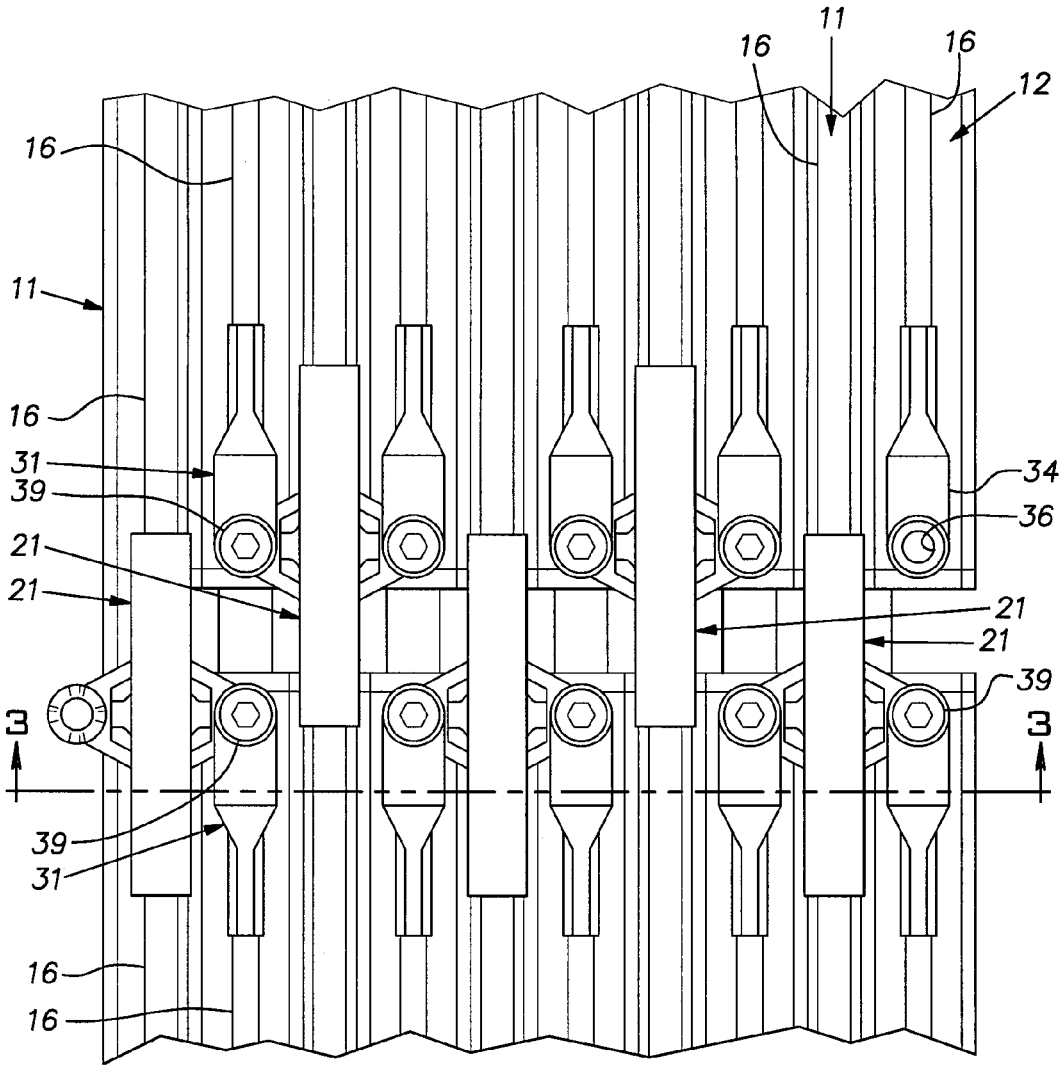
FIG. 2 is a fragmentary plan view of an area of cross tee and main tee joints with the module in a folded or collapsed condition.

The invention is diagrammatically illustrated in FIGS. 1A through 1D where a folded grid assembly or module 10 (FIG. 1A) is progressively opened or expanded to a fully deployed or expanded configuration (FIG. 1D). The grid module 10 comprises relatively long main tees 11 typically nominally 10 foot in length and shorter cross tees 12, typically nominally two foot in length. Metric equivalent lengths can be used for the main and cross tees. The cross section of the illustrated tees 11, 12 is conventional with a horizontal lower flange 13 extending laterally symmetrically on both sides of a lower edge of a vertically extending plane of a web 14. A hollow reinforcing bulb 16 extends laterally symmetrically along the top of the web 14. Typically, as known in the art, the tees 11, 12 are roll-formed from sheet steel.

The ends of the cross tees 12 are hinged to the main tees 11 at regularly spaced locations along the lengths of the main tees 11. These locations along the main tees 11 correspond to conventional locations and in the illustrated example are on two foot centers or metric equivalent. In the illustrated example, the module 10 comprises five main tees 11 and 25 cross tees 12.

Identical brackets 21 are centered and fixed on the main tees 11 at locations corresponding to points where extended center lines of the cross tees 12 intersect the main tees at right angles when the module 10 is in its expanded installed condition. The illustrated bracket 21 serves to couple an end of a separate cross tee 12 on each side of the main tee 11 to which it is mounted. The bracket 21 of the illustrated style can be die cast of suitable metal or molded of a suitable fire retardant plastic. The bracket 21 has a central main body with a cross-section transverse to its longitudinal direction of an inverted U. A slot 23 of this main body 22 is complementary to the cross-sectional shape of the main tee 11 in the area of its bulb 16 enabling it to be snapped over the tee or slid lengthwise from the end of the tee to a desired location thereby giving the main body a saddle-like relation to the tee. The bracket 21 can be fixed in place on the tee 11 by screws, rivets, or like fasteners assembled in holes 24. On each of a pair of opposed legs 26 straddling the tee 11, the bracket 21 includes an integral lateral extension 27 near its lower edge. Each extension 27 has a vertical counterbore 28 proportioned to receive a vertical shoulder bolt 29 that operates as a hinge pin with its longitudinal axis forming a pivot center spaced from the central plane or web 14 of the respective main tee 11. Each end of a cross tee 12 is fitted with a hinge connector bracket 31. Like the main tee bracket 21, the cross tee bracket 31 can be die cast of metal or molded of a suitable plastic. The cross tee bracket 31 has an inverted U-shaped portion 32 that is assembled, saddle-like, over the cross tee bulb 16 and upper area of the web 14. The bracket 31 is fixed to the cross tee 12 with screws or other fasteners positioned in holes 33. The bracket 31 includes a coupling arm 34 that extends upwardly and longitudinally from the U-shaped saddle part 32. The arm 34 has a vertical through bore 36 of a diameter essentially the same or slightly larger than the major diameter of the main tee bracket extension counterbore 28. The axis of the bore 36 lies in the plane of the web 14 of the cross tee 12. The shoulder bolt 29 is assembled in the bracket bores 28, 36 to couple an associated end of a cross tee 12 to a main tee 11. The shoulder of the bolt 29 abuts the bottom of the counterbore 28 in the extension 27 and the bolt is retained in place by a nut 37. The bolt 29 has a shank length long enough to carry a compression spring 38 between its head 39 and a top surface of the coupling arm 34.

Figure 3:
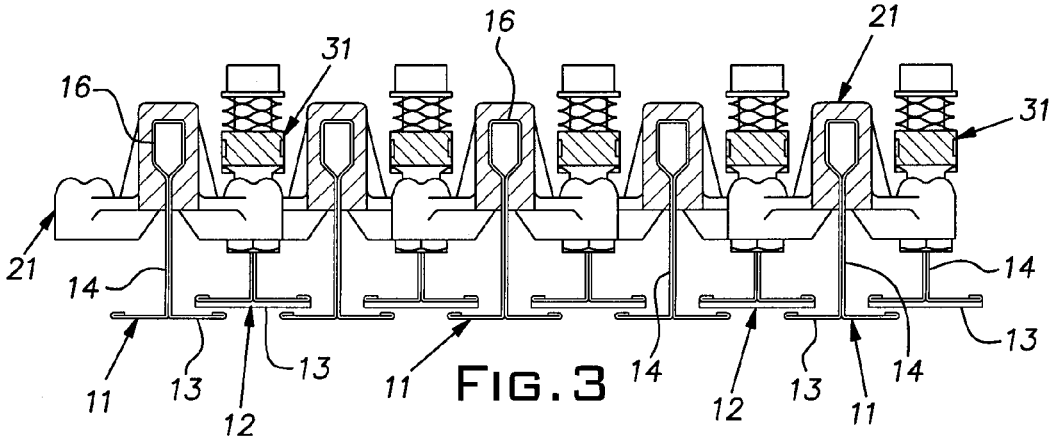
FIG. 3 is a cross-section elevational view of the grid module in a folded condition.
Figure 3A:
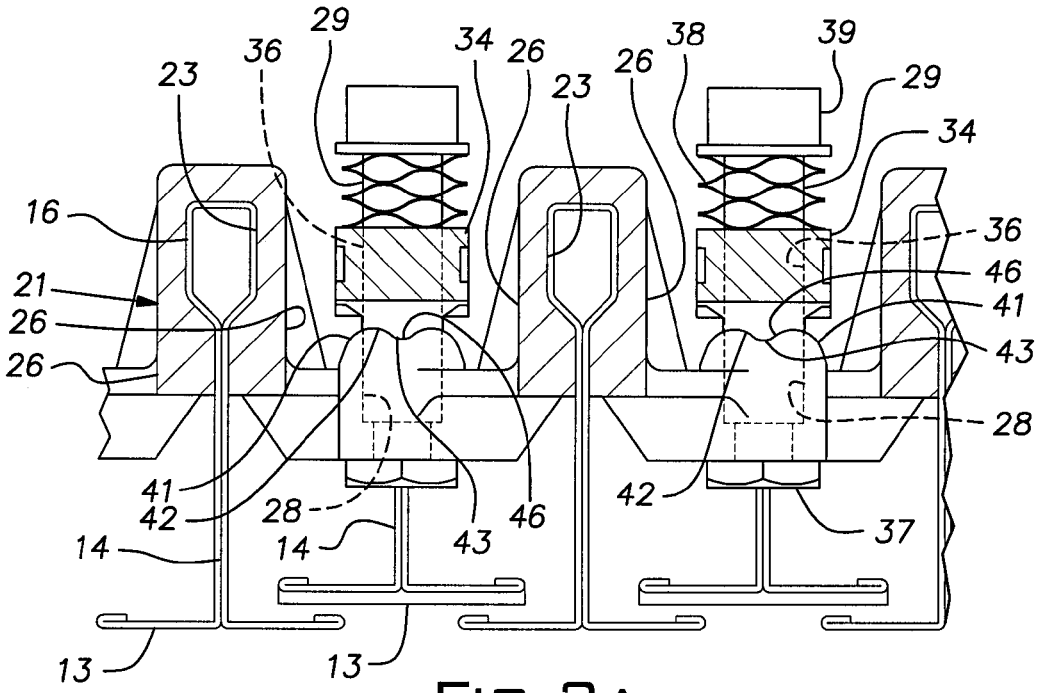
FIG. 3A is a fragmentary cross-sectional view similar to FIG. 3, but on an enlarged scale.
Figure 4:
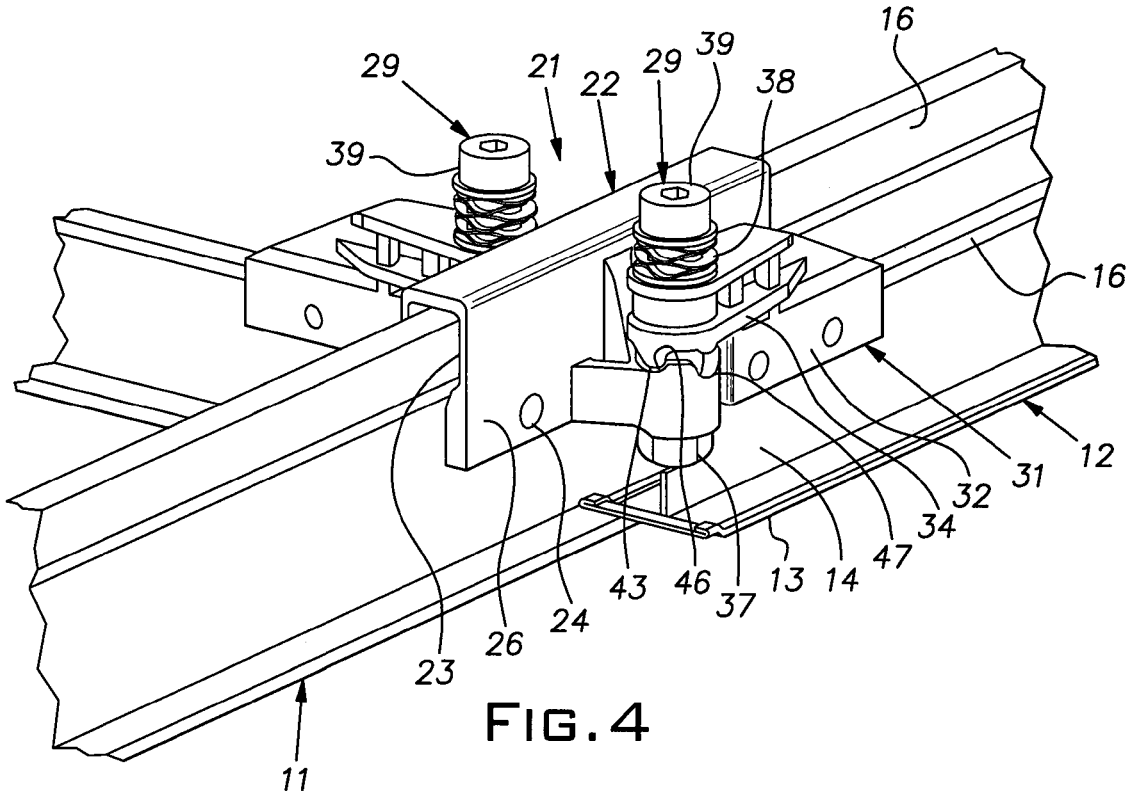
FIG. 4 is a perspective view of a main tee and cross tee joint area showing the cross tee in the foreground in a folded condition.
Figure 5:
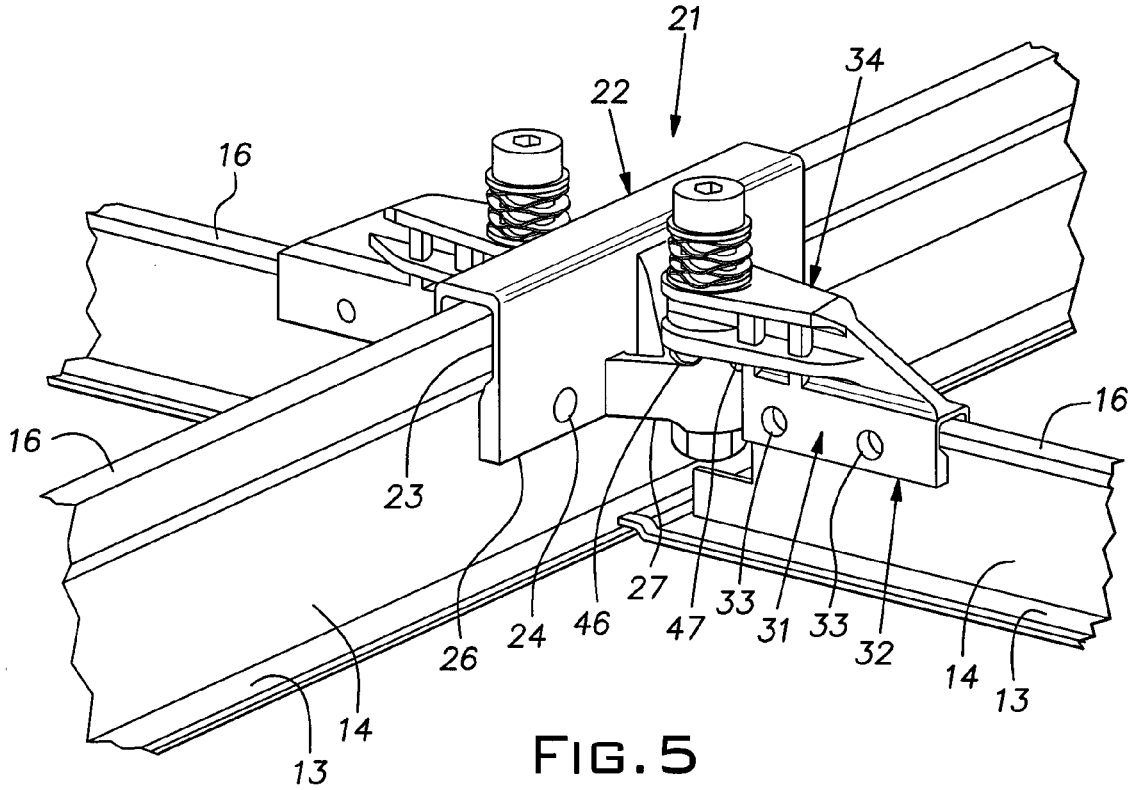
FIG. 5 is a perspective view of a joint area between a main tee and opposed cross tees in their unfolded or expanded position.

Mating surfaces 41, 42 of the main and cross tee bracket extension and arm 27, 34 have complimentary crown-like configurations that provide a detent action that releasably locks the cross tee 12 in either a collapsed position generally aligned with the associated main tee 11 or a deployed position where it is at right angles to the main tee. This detent action involves rounded downward projections 43 on opposite sides of the bore 36 on the lower face of the cross tee bracket arm 34 that fit in rounded notches 46, 47 on the upper face of the main tee extension 27. Shallower notches 46 correspond to the collapsed position of the cross tee and the deeper notches 47 correspond to the deployed position. The compression spring 38 biases the cross tee projections 43 into the notches 46, 47 to releasably maintain the cross tee in either the collapsed or the deployed position. Preferably in the collapsed position, the cross tee 12 is maintained parallel to the main tee 11 to which it is coupled as well as all of the other main tees and cross tees. In the deployed or expanded position, the detent action of all the projections 43 serves to hold the grid module 10 square. Preferably, the brackets 21, 31, are proportioned to hold the cross tee flanges 13 slightly above and out of contact with the flanges 13 of the main tees 11 as shown in FIG. 3A when the projections 43 rest in shallow notches 46.

Referring back to FIGS. 1A-1D, the grid module 10 in a collapsed or folded condition represents a package that, by way of example, is 143"×7.25"×2" (11.92'×0.61'×0.17'). When this module is fully expanded, it can cover an area 10'×10'. It will be seen essentially no labor is expended in the field in assembling the cross tees 12 to the main tees 11 within the module 10 thereby offering considerable speed in installation. The invention is particularly suited for use in large areas where modules 10 can be quickly joined together along their margins and the ends of a limited number of cross pieces are attached to the successive modules.

While the invention has been disclosed in reference to a grid having 2'×2' sections, it will be understood that other conventional arrangements, such as 2'×4', or 2½'×5' arrangements can be produced by the invention. These sizes can be adapted to metric equivalents.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A preassembled suspended ceiling grid module comprising a plurality of parallel main tees and a plurality of cross tees, the main tees having a nominal length that exceeds twice the nominal length of the cross tees, the main and cross tees each having horizontal flanges extended to both sides of a central plane, the cross tees being joined at each of their ends to the main tees with end connections that enable the module to be folded in a plane corresponding to an eventual ceiling plane in a zigzag pattern, such that the cross tees lie in directions generally parallel to the main tees with a plurality of the cross tees connected on a side of a particular main tee being folded in a common direction relative to their end connections, and where connected to an adjacent main tee said plurality of cross tees being folded in an opposite direction relative to their end connections with said adjacent tee.

2. A preassembled suspended ceiling grid as set forth in claim 1, wherein said end connections each provide a hinge center spaced from the central plane of the respective main tee.

3. A preassembled suspended ceiling grid as set forth in claim 2, wherein each hinge center is spaced from the central plane of the respective main tee a distance at least equal to half of the width of the flange of a cross tee.

4. A preassembled suspended ceiling grid as set forth in claim 1, wherein said connection includes a spring action to bias the associated cross tee to a deployed position in which it is at right angles to the associated main tee.

5. A preassembled suspended ceiling grid as set forth in claim 4, wherein said connection includes a spring action to bias the associated cross tee to a folded position in which it is parallel to the associated main tee.

6. A preassembled suspended ceiling grid as set forth in claim 1, wherein said connection includes a vertical hinge pin.

7. A preassembled suspended ceiling grid as set forth in claim 1, wherein the cross tees connected on an outside of an outer one of said main tees have their distal ends free of attachment of a main tee.

8. A preassembled suspended ceiling grid as set forth in claim 1, wherein said connection includes mating brackets on the main tee and on the cross tee.

9. A preassembled suspended ceiling grid module comprising a plurality of parallel main tees and a plurality of cross tees, the main tees having a nominal length that exceeds twice the nominal length of the cross tees, the main and cross tees each having horizontal flanges extended to both sides of a central plane, the cross tees being joined at each of their ends to the main tees with end connections that enable the module to be folded in a plane corresponding to an eventual ceiling plane in a zigzag pattern, such that the cross tees lie in directions generally parallel to the main tees with a plurality of the cross tees connected on a side of a particular main tee being folded in a common direction relative to their end connections, and where connected to an adjacent main tee said plurality of cross tees being folded in an opposite direction relative to their end connections with said adjacent tee, each of said connections allows the flange of its associated cross tee to overlie the flange of the main tee to which it is connected and to overlie the adjacent main tee flange to which the opposite end of the associated cross tee is connected.

10. A preassembled grid for a suspended ceiling comprising a plurality of main tees and sets of cross tees, the main tees having a nominal length that exceeds twice the nominal length of the cross tees, the main and cross tees each including a central vertical web and a lower horizontal flange extending on both sides of the web, a plurality of the cross tees being connected to the main tees at spaced intervals along each of the main tees in a manner that enables the cross tees to be folded towards the main tees and the main tees to be spaced in parallel relation with a separation between adjacent main tees substantially less than the length of the cross tees wherein the connection between a cross tee and a main tee allows relative vertical movement there between when the cross tee is moved between a folded condition to a right angle condition.

11. A preassembled grid as set forth in claim 10, wherein the connection between cross tees and a respective main tee produces a fold center displaced laterally of a central web of such respective main tee.

12. A preassembled grid as set forth in claim 11, wherein the fold center is displaced from the central web a distance greater than one-half the width of the flange of the cross tee.

13. A preassembled grid as set forth in claim 11, wherein the fold center has a fixed vertical axis.

14. A preassembled grid as set forth in claim 13, wherein the fold center is formed by a vertical pin.

15. A preassembled grid as set forth in claim 10, wherein the cross tee is resiliently biased downwardly relative to the respective main tee by a spring element.

16. A preassembled grid as set forth in claim 10, wherein the connection between the cross tee and the main tee has elements that bias the cross tee to one orientation where it lies at a right angle relative to the main tee.

17. A preassembled grid as set forth in claim 10, wherein the connection between a cross tee and a main tee includes an element that biases the cross tee to an orientation where it lies in close proximity to the main tee when it is folded.

18. A preassembled grid as set forth in claim 17, wherein said biasing element biases the cross tee to a position parallel to the main tee.

19. A preassembled grid for a suspended ceiling comprising a plurality of relatively long parallel main tees and a plurality of relatively short cross tees intervening adjacent main tees, said main and cross tees having horizontal flanges extending laterally from a lower edge of a central web, said cross tees having their opposite ends connected to adjacent main tees by a series of brackets attached to said main tees at regularly spaced locations, the spacing between brackets on a given main tee being greater than the length of the cross tees, said brackets each providing support for a vertical hinge axis for hinging a respective end of an associated cross tee, said brackets supporting said cross tees for hinging motion about said vertical axes in a folded condition where said adjacent main tees are spaced relatively close to one another and said cross tees are generally longitudinally aligned with said main tees and in an expanded operational condition perpendicular to said main tees for supporting ceiling tiles on their flanges.

20. A preassembled grid as set forth in claim 19, wherein said brackets provide a detent action to hold associated cross tees in their respective operational conditions.

21. A preassembled grid as set forth in claim 19, wherein said brackets provide a cam surface for lifting said cross tees above a plane of their operational condition to hold the flanges of the cross tees nested in spaces between the flanges of the main tees between which they intervene.

22. A preassembled grid as set forth in claim 21, wherein the hinged ends of said cross tees are biased downwardly by a resilient spring.

23. A preassembled grid as set forth in claim 21, wherein said brackets provide a detent action to releasably hold associated cross tees in the respective folded condition.

* * * * *